US005934514A

United States Patent [19]

Lampe et al.

[11] Patent Number: 5,934,514

[45] Date of Patent: Aug. 10, 1999

[54] DISPENSING VALVE CLOSURE WITH INNER SEAL

[75] Inventors: William H. Lampe, Marietta; Inocencio Martinez, Kennesaw; John F. Kaiser, Snellville, all of Ga.; John M. Hess, Waukesha, Wis.; Jeffrey T. Randall, Oconomowoc, Wis.; Christopher J. Wood, Wauwatosa, Wis.

[73] Assignees: AptarGroup, Inc., Crystal Lake, Ill.; The Coca-Cola Company, Atlanta, Ga.

[21] Appl. No.: 09/113,250

[22] Filed: Jul. 10, 1998

Related U.S. Application Data

[63] Continuation of application No. 08/519,492, Aug. 25, 1995.

[51] Int. Cl.[6] ..... B67D 5/32

[52] U.S. Cl. ..... 222/153.06; 222/494; 215/232; 220/359.4

[58] Field of Search ..... 222/153.05, 153.06, 222/153.07, 212, 213, 490, 494, 545, 562, 542, 556, 541.5, 541.1, 541.9; 220/256, 258, 359; 215/232

[56] References Cited

U.S. PATENT DOCUMENTS

| | | | |
|---|---|---|---|
| 4,171,749 | 10/1979 | Obrist et al. . | |
| 4,872,571 | 10/1989 | Crecelius et al. . | |
| 4,993,606 | 2/1991 | Bolen, Jr. et al. | 222/556 |
| 5,115,950 | 5/1992 | Rohr . | |
| 5,213,236 | 5/1993 | Brown et al. . | |
| 5,271,531 | 12/1993 | Rohr et al. . | |
| 5,307,955 | 5/1994 | Viegas . | |
| 5,390,805 | 2/1995 | Bilani et al. . | |
| 5,551,608 | 9/1996 | Moore et al. . | |
| 5,626,262 | 5/1997 | Fitten et al. . | |
| 5,632,420 | 5/1997 | Lohrman et al. | 222/212 |

FOREIGN PATENT DOCUMENTS

| | | |
|---|---|---|
| 0 323 370 | 7/1989 | European Pat. Off. . |
| 1 228 265 | 8/1960 | France . |
| 172 438 | 9/1952 | Germany . |
| 297 06 456 | 9/1998 | Germany . |
| 184447 | 8/1938 | Switzerland . |

OTHER PUBLICATIONS

"Sample closure marketed on Wesson™ Stir Fry Oil bottle" (No date).

*Primary Examiner*—Philippe Derakshani
*Attorney, Agent, or Firm*—Alston & Bird LLP

[57] ABSTRACT

A dispensing valve closure (10) is provided which includes a closure body (12) and a cap (14). A self-sealing dispensing valve (16) is disposed within the closure (10) and is held in place with a retaining ring (18). An inner seal (20) is also placed within the closure (10) to allow for sealing on a package.

19 Claims, 3 Drawing Sheets

DISPENSING VALVE CLOSURE WITH INNER SEAL

CROSS REFERENCE TO RELATED APPLICATION

This application is a continuation of application Ser. No. 08/519,492, filed Aug. 25, 1995.

TECHNICAL FIELD OF THE INVENTION

This invention relates generally to closures, and more particularly to a dispensing valve closure with an inner seal.

BACKGROUND OF THE INVENTION

A myriad of packages exist for containing materials that flow (generally referred to herein as "fluids"), such as beverages, soaps, foods, powders and chemicals, among many others. These packages are filled with the fluids through openings, such as that provided at the finish area of bottles. These openings are then sealed for distribution of the packages. The sealing is generally done with a closure, of which there are a large number of different types.

In the beverage industry, closures used for many packages, including bottles, are Generally of the screw-on type, and may be repeatedly removed and resealed. Recently, however, an increasing number of beverage closures include dispensing valves that allow the beverages to flow through the closure for consumption, without removal of the closure. The most widely used dispensing closure is the pull-push dispensing closure, similar to that used on many liquid dish-washing soap packages.

The pull-push closure, however, has significant drawbacks. For example, it requires the user to manually pull the spout open and closed. Also, if the user does not close the spout, the package will leak, since the spout has no value to automatically reseal.

A self-closing dispensing valve has been developed for use with fluids other than those suitable for consumption, for example for use with liquid soaps and lotions. Such a self-closing valve is disclosed in U.S. Pat. No. 5,213,236, issued on May 25, 1993 to Brown et al., entitled "DISPENSING VALVE FOR PACKAGING." However, the packages and closures used in connection with such dispensing valves have not been designed for aseptic, hot fill, or other cold-filled preserved products.

Therefore, a need has arisen for a dispensing valve closure that is self-sealing (also referred to as self-closing), and that is suitable for use in the food and beverage industries.

SUMMARY OF THE INVENTION

In accordance with the teachings of the present invention, a self-sealing dispensing valve closure that accommodates an inner seal is provided which substantially reduces or eliminates disadvantages and problems associated with prior art dispensing valves.

In particular, a sealing and dispensing device for a package that contains a fluid is provided. A closure is provided which is shaped to engage with the package. Furthermore, an inner seal is provided which is operable to seal on a land area of the package. A self-sealing dispensing valve is disposed within the closure opposite the inner seal from the fluid.

This device is particularly suited to the food and beverage industry, and in particular for fluids such as isotonic or non-isotonic sports drinks. It should be understood that this illustration is exemplary only, and the present invention may be used with a wide range of foods, beverages, and other fluids, including teas, juices, fruit drinks, water, and flavored water, among many other fluids.

In a particular embodiment, the inner seal is an induction seal. With an induction seal, a hermetic, vacuum retaining seal can be provided for sealing the package and fluid. Such sealing is important in the food and beverage industry, so as to maintain product integrity, and eliminate the possibility of leakage in distribution.

An important technical advantage of the present invention is the fact that the self-sealing dispensing valve is disposed in the closure of the present invention in such a manner as to accommodate an inner seal for sealing on the land area of a package.

BRIEF DESCRIPTION OF THE DRAWINGS

For a more complete understanding of the present invention and the advantages thereof, references now made to the following description taken in conjunction with the accompanying drawings in which like reference numbers indicate like features and wherein.

DETAILED DESCRIPTION OF THE INVENTION

Figure 1:
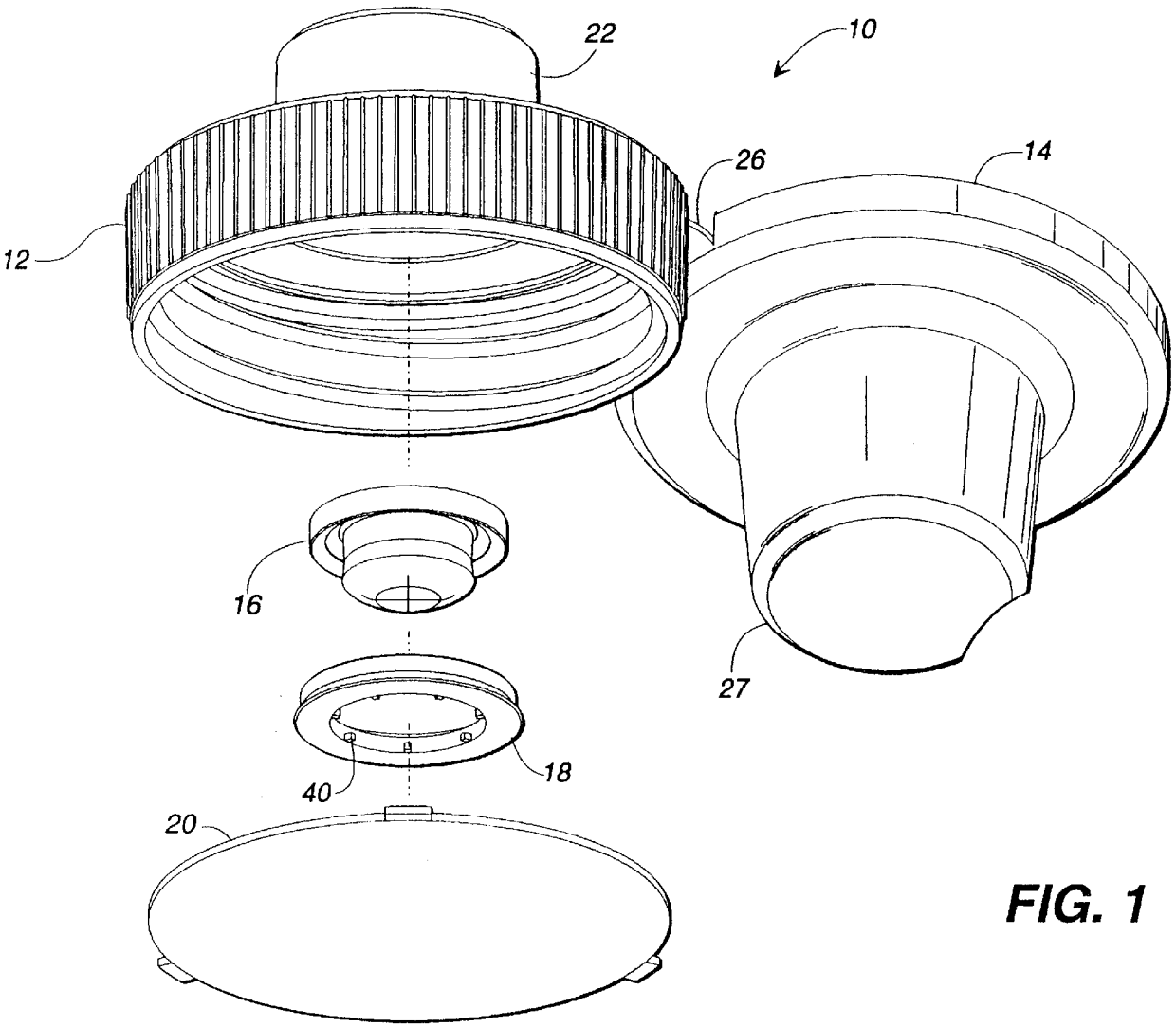
FIG. 1 illustrates an exploded view of a particular embodiment of a dispensing valve closure that accommodates an inner seal, according to the teachings of the present invention.

FIG. 1 illustrates an exploded view of a particular embodiment of a dispensing valve closure 10 according to the teachings of the present invention. As shown in FIG. 1, dispensing valve closure 10 includes a closure body (or shell) 12, a cap or overcap 14, a self-sealing dispensing valve 16, and a retaining ring (or cartridge) 18. Also shown is an inner seal 20, which, as will be discussed below, provides a seal to prevent the fluid from contacting the closure 10 or any of its components, for example during transportation and storage of shelf-stable packaged beverages, such as isotonic and non-isotonic sports drinks. Closure body 12, in the particular embodiment shown in FIG. 1, includes an internally threaded sleeve 28 for threadedly attaching the closure to an externally threaded outlet opening of a container or package. The closure body 12 further includes a tubular spout or boss 22 of substantial height and which is adapted to communicate with the outlet opening of the container and through which the liquid contained in the container is adapted to be dispensed. The diameter of the spout 22 is substantially less than the diameter of the threaded sleeve 28, and the spout is joined to the threaded sleeve by means of a generally flat annular flange.

Self-sealing dispensing valve 16 may be any suitable self-sealing dispensing valve. A particular example of a self-sealing dispensing valve that may be used is disclosed in U.S. Pat. No. 5,213,236, issued on May 25, 1993 to Brown et al., and entitled "DISPENSING VALVE FOR PACKAGING." That patent is herein incorporated by reference. The self-sealing dispensing valve may be formed from a resiliently flexible material, and in particular may be formed from a silicone rubber that is substantially inert, thus avoiding deleterious reaction with the food, beverage, or other fluid to be dispensed.

The self-sealing dispensing valve 16 allows fluid to be dispensed by increasing the pressure within the package, or example through squeezing of the package. Once the pressure is released, the valve 16 automatically seals, thus preventing leaking.

As will be discussed in detail below, self-sealing dispensing valve 16 is disposed within boss 22 and held in place by retaining ring 18 or other device, such as a cartridge. Prior to application of the closure 10 to the package to be sealed, the inner seal 20 is preferably placed within the closure body 12, proximate to retaining ring 18. The inner seal 20 seals the package on which closure 10 is placed, thereby preventing the fluid within the package from coming into contact with the dispensing valve closure 10 or any of its components, until the inner seal 20 is removed. In the food and beverage industries, it is often important that the fluid be hermetically sealed, to maintain the integrity of the fluid, for example to prevent the growth of microorganisms in the fluid after filling.

The present invention accommodates the need to provide such a seal, and yet allows the use of a self-sealing dispensing valve. In particular, this is accomplished by disposing the self-sealing dispensing valve above the "land area" of the package finish, on which inner seal 20 forms its seal. A significant technical advantage of the present invention is the accommodation of both an inner seal and a self-sealing dispensing valve, thereby allowing the use of self-sealing dispensing valves in industries such as the food and beverage industries, which often require shelf stable packaging.

Figure 2:
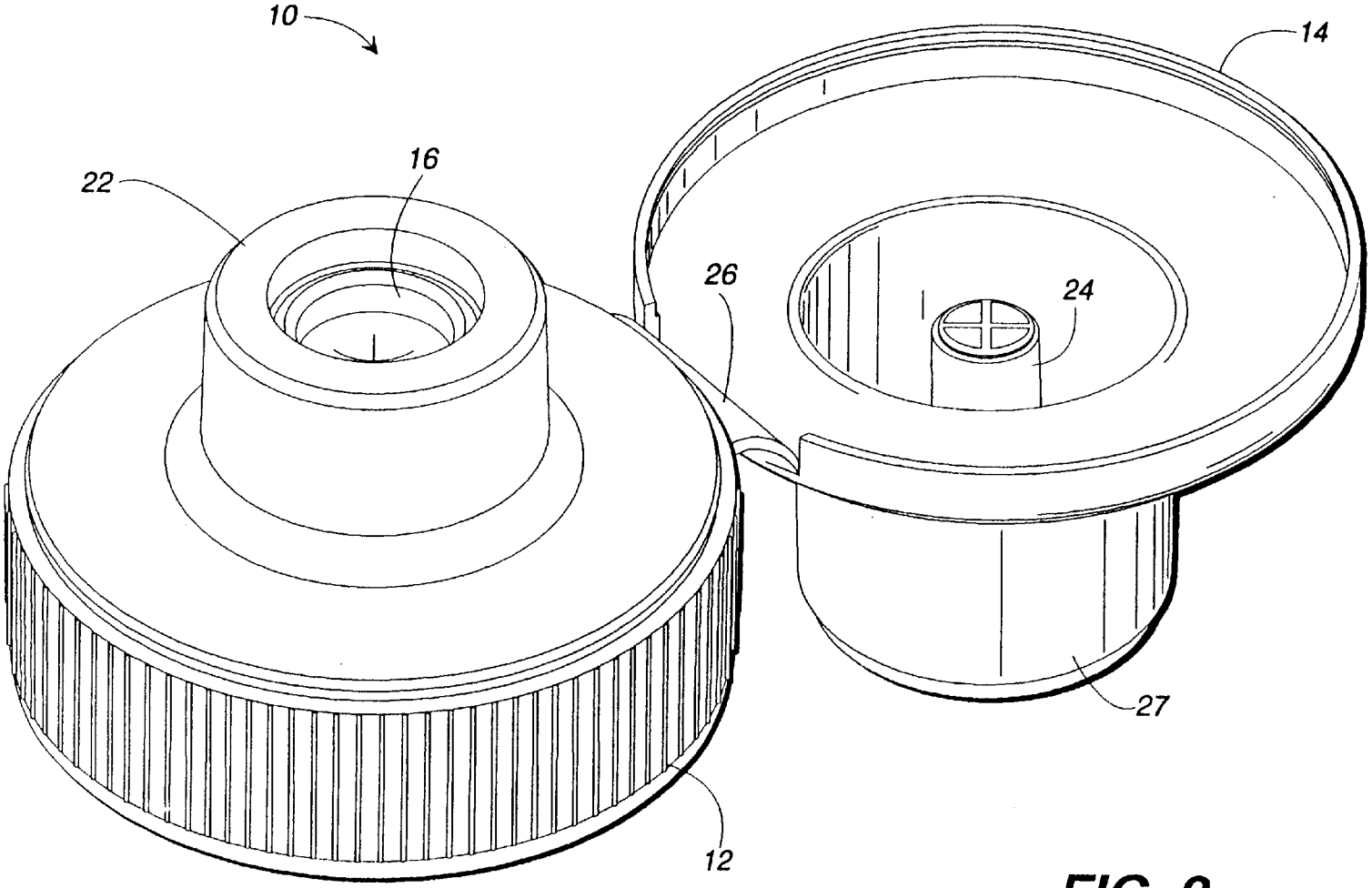
FIG. 2 illustrates an isometric to p view of a particular embodiment of a dispensing valve closure according to the teachings of the present invention.

FIG. 2 illustrates an isometric top view of the dispensing valve closure shown in FIG. 1. As shown in FIG. 2, the cap 14 has a central hollow dome 27 of a height sufficient to receive the spout, and a central post 24 is positioned coaxially within the dome of the cap. Cap 14 provides a cover for dispensing valve 16 and the spout 22. In the particular embodiment shown in FIG. 2, cap 14 is connected to closure body 12 with a hinge 26. The particular connection shown between cap 14 and closure body 12 is exemplary only, however, as thus connections other than hinges may be used. Furthermore, cap 14 need not be connected to closure body 12. For example, cap 14 can be separate from closure body 12, and may be snapped onto and off of closure body 12. Furthermore, cap 14 may be omitted altogether without departing from the intended scope of the present invention. As shown in FIG. 2, the spout 22 is formed with an internal bore to allow fluid to pass through the self sealing dispensing valve 16 and to the user.

As discussed above, cap 14 includes a central post 24. The central post 24 is provided to prevent self-sealing dispensing valve 16 from opening while the cap 14 is snapped onto closure body 12. The central post 24 is disposed within cap 14 and shaped so that, when cap 14 is closed, central post 24 is disposed within the cavity of the self sealing dispensing valve 16.

It should be understood that the particular shape of closure 10, closure body 12, cap 14, and the spout 22 are exemplary only, and other structures may be used without departing from the intended scope of the present invention. The term "closure" is used herein to refer to any such structures, alone or in combination.

As shown in FIGS. 1 and 2, the dome 27 of the cap 14 serves as a flip lever, to facilitate flipping of the closure body 12. This flip lever need not be included, or may be shaped differently than that shown in FIGS. 1 and 2. Similarly, as shown in FIGS. 1 and 2, the spout 22 has a diameter less than that of the threaded sleeve 28 of the closure body 12. However, they may be formed to have the same diameter, or shaped much differently than shown without departing from the intended scope or the present invention.

Figure 3:
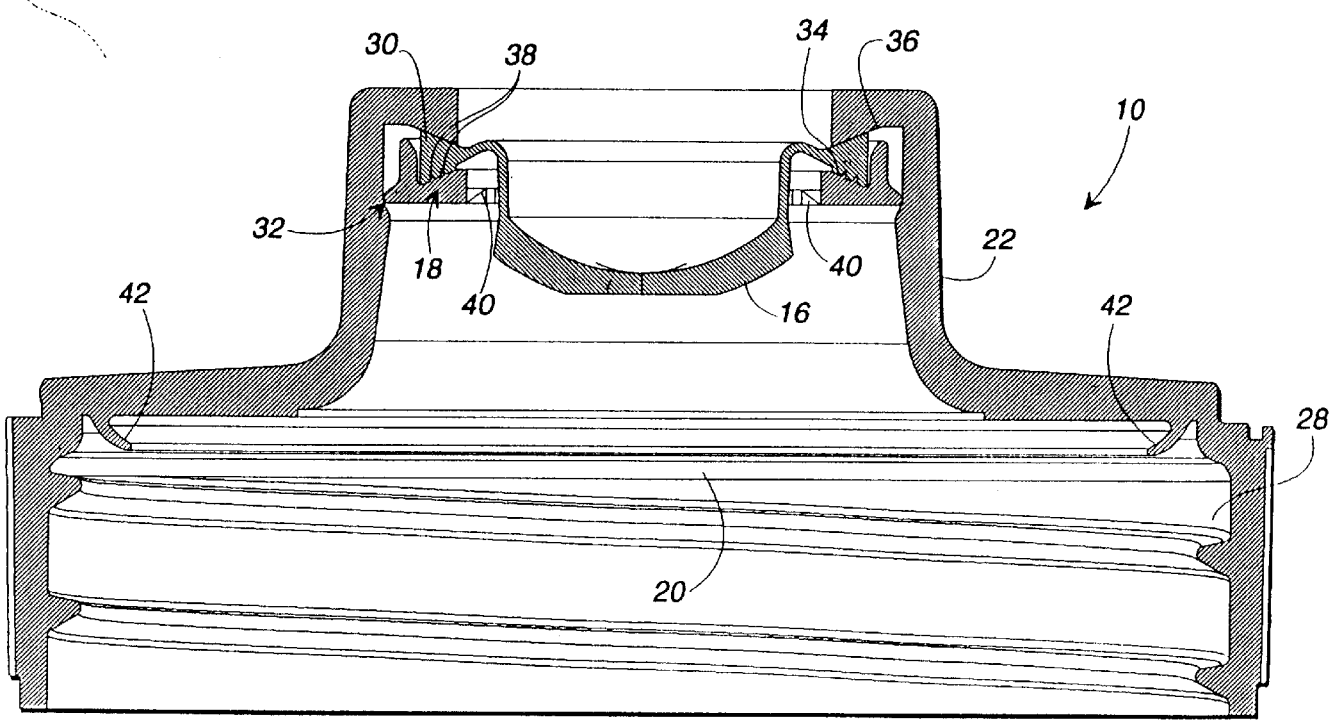
FIG. 3 illustrates a sectional view of a particular embodiment of a dispensing valve closure that accommodates an inner seal, according to the teachings of the present invention.

FIG. 3 illustrates a cross sectional side view of dispensing valve closure 10. As shown in FIG. 3, the inside surface of the threaded sleeve 28 of the closure body 12 is threaded with threads so as to accommodate a threaded package. However, it should be understood that threads are exemplary only, and that the closure body 12 may engage with the package other than with threads, such as by bonding, or with other techniques or structures.

As shown in FIG. 3, retaining ring 18 supports a marginal flange 30 of self-sealing dispensing valve 16. Retaining ring 18 is held in place by a concentric shoulder 32 formed along the inside surface of the spout 22. As can be seen in FIG. 3, the retaining ring 18 is formed with a shoulder 34, and the marginal flange 30 is held in place between the retaining ring shoulder 34 and an inside surface 36 of the spout 22.

To assist in retaining the self-sealing dispensing valve 16, shoulder 34 of the retaining ring 18 may be formed with teeth or ribs 38 as shown in FIG. 3. The structures 38 assist in holding the marginal flange 30, thereby reducing the likelihood that the self-sealing dispensing valve 16 will be dislodged upon the build up of pressure within the package.

Although a retaining ring is shown in the FIGURES, it should be understood that the self-sealing valve 16 may be held in place with any suitable device, such as a cartridge or other retaining device.

Also shown in FIG. 3 are guides 40. These guides, which are also shown in FIG. 1, assist in maintaining the axial orientation of self-sealing dispensing valve 16 with the other components of the dispensing valve closure 10.

FIG. 3 also illustrates the inner seal 20. As shown, the inner seal 20 is placed within the closure body 12, and is adjacent to a package seal 42. As will be discussed, the inner seal 20 seals on the land area of the package after the closure 10 is placed on the package. The package seal 42 provides a seal between the package and the closure body 12 after the inner seal 20 has been removed. The particular package seal 42 shown in FIG. 3 is of the crab claw variety, however other package seals may also be used, such as concentric ribs or other structures.

Figure 4:
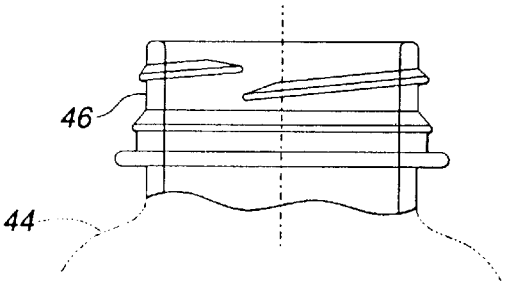
FIG. 4 illustrates a side view of a typical bottle finish that may be used with particular embodiments of closures according to the teachings of the present invention.

FIG. 4 illustrates an exemplary package finish which may be used with a dispensing valve closure according to the teachings of the present invention. The particular package finish shown in FIG. 4 is a threaded bottle neck. During the filling process, beverages or food are be filled into the package 44, and then dispensing valve closure 10 is placed upon the finish area 46. The inner seal 20 contacts the land area (or rim) of the finish area 46 to provide the inner seal. "Land area" refers to any such area for sealing. Any suitable inner seal may be used, including induction seals, heat seals, self-adhesive seals, friction seals, any seals providing hermetic or vacuum seals, or any other suitable seal.

In use, the closure body 12 is removed, and the inner seal 20 is then removed from the finish area 46 of the package 44. The closure body 12 is then replaced, and fluid can then be dispensed through the self-sealing dispensing valve 16.

A particular inner seal 20 that may be used is an induction seal, such as those supplied by the Unipak Company of Ontario, Canada. Such seals include, for example, an aluminum layer surrounded by an insulation layer on top and a sealing layer on the bottom. The insulation layer on top provides heat insulation for protecting the package seal 42 from the heat that is used to cause the sealing layer to seal to the finish area 46 package. With an induction seal, once the closure body 12 is placed on the package, the package is passed under the induction sealer to induce currents, and therefore heat, within the aluminum layer of the induction seal. This heat causes a bonding between the sealing layer and the bottle finish. The inner seal 20 may incorporate various features to ease removal, such as pull tabs, tri-tabs, or other such devices.

Furthermore, it should be understood that seals that are applied directly to the package, and not carried by the closure, may also be used without degrading from the intended scope herein.

In summary, a self-sealing dispensing valve closure is provided which accommodates the use of an inner seal. This is accomplished by disposing the self-sealing dispensing valve opposite the inner seal from the finish area of the package to be sealed. Therefore, products that require hermetic or other sealing, such as those used in the food and beverage industries, may take advantage of self-sealing dispensing valves.

Although the present invention has been described in detail, it should be understood that various changes, substitutions, modifications, or alterations may be made without departing from the intended scope herein, as defined by the intended claims.

What is claimed is:

1. A sealing and dispensing closure for an outlet opening of a container containing a consumable beverage or other liquid, and comprising a closure body adapted to be assembled to the outlet opening of the container, said closure body including a tubular spout of substantial height and which is adapted to communicate with the outlet opening of the container and through which the liquid contained in the container is adapted to be dispensed, a self sealing dispensing valve which includes a marginal annular flange, and which is movable by pressure within the container between a closed position and an open position, and means mounting said self sealing dispensing valve within said spout and including an inwardly facing annular surface within said spout, with said marginal annular flange of said valve overlying said annular surface, an annular shoulder within said spout and spaced below said annular surface, and an annular retaining ring supported by said annular shoulder in said spout and engaging the side of the marginal annular flange opposite the annular surface.

2. The closure as defined in claim 1 wherein the closure body further includes an internally threaded sleeve which is adapted to be threadedly joined to the outlet opening of the container and which has a predetermined axial height, and wherein said spout has a height which at least equals about one half the predetermined axial height of the sleeve.

3. The closure as defined in claim 2 wherein the diameter of the spout is substantially less than the diameter of the threaded sleeve, and wherein the spout is coaxially joined to the threaded sleeve by means of a generally flat annular flange.

4. The closure as defined in claim 3 further comprising a circumferential seal positioned within the threaded sleeve of the closure body for sealably engaging the outlet opening of the container when the closure is threadedly assembled thereon.

5. The closure as defined in claim 4 further comprising an inner seal positioned within said internally threaded sleeve for engaging and sealably closing the outlet opening of the container when the closure is threadedly assembled thereon.

6. The closure as defined in claim 1 wherein the self sealing dispensing valve is configured so as to assume a generally downwardly concave configuration which is wholly within the spout in its said closed position.

7. A package for containing and dispensing a consumable beverage or other liquid, and comprising a container having a flexible body portion and an externally threaded outlet opening, a sealing and dispensing closure joined to the outlet opening of the container and comprising (a) a closure body which includes a tubular spout of substantial height and which communicates with the outlet opening of the container and through which the liquid contained in the container is adapted to be dispensed, said spout having an internal bore which includes an inwardly facing annular surface and an annular shoulder spaced below said annular surface, (b) a self sealing dispensing valve mounted within said spout and being movable by pressure within the container between a closed position and an open position, said self-sealing dispensing valve including a marginal flange overlying said annular surface, and (c) an annular retaining ring supported by said annular shoulder and engaging the side of the marginal flange opposite the annular surface.

8. The package as defined in claim 7 wherein said sealing and dispensing closure is removably joined to the outlet opening of the container by cooperating threads, and further comprising an inner seal sealably closing the outlet opening of said container, with said inner seal being removable from the outlet opening when the sealing and dispensing closure is removed from the outlet opening.

9. The package as defined in claim 7 wherein said outlet opening of said container is externally threaded, and wherein said closure body includes an internally threaded sleeve which is threadedly joined to the outlet opening of the container.

10. The package as defined in claim 9 wherein the threaded sleeve of the closure body has a predetermined axial height, and wherein said spout has a height which at least equals about one half the predetermined axial height of the sleeve.

11. The package as defined in claim 10 wherein the diameter of the spout is substantially less than the diameter of the threaded sleeve, and wherein the spout is coaxially joined to the threaded sleeve by means of a generally flat annular flange.

12. The package as defined in claim 7 wherein the self sealing dispensing valve is configured so as to assume a generally downwardly concave configuration which is wholly within the spout in its said closed position.

13. A sealing and dispensing closure for an outlet opening of a flexible container containing a consumable beverage or other liquid, and comprising a closure body including an internally threaded sleeve which is adapted to be threadedly joined to the outlet opening of the container and which has a predetermined axial height, and a tubular spout extending axially outwardly from the threaded sleeve a substantial distance and which is adapted to communicate with the outlet opening of the container and through which the liquid contained in the container is adapted to be dispensed, a self sealing dispensing valve mounted within said spout, and which is movable by pressure within the container between a closed position and an open position, and an overcap mounted for selective movement between a covering position mounted on the closure body and enclosing the spout of the closure body and a removed position wherein the spout is exposed and the liquid may be dispensed therethrough by squeezing the container which increases the pressure in the container and in turn causes the valve to move to its open position.

14. The closure as defined in claim 13 wherein said spout has an axial height which is at least about one half the predetermined axial height of the sleeve.

15. The closure as defined in claim 14 wherein the diameter of the spout is substantially less than the diameter of the threaded sleeve, and wherein the spout is coaxially joined to the threaded sleeve by means of a generally flat annular flange.

16. The closure as defined in claim 13 wherein the self sealing dispensing valve is configured so as to assume a generally downwardly concave configuration which is wholly within the spout in its said closed position.

17. The closure as defined in claim 13 wherein said spout has a height which is sufficient to permit sealing engagement thereof with the lips of a consumer.

18. The closure as defined in claim 13 wherein said spout extends axially outwardly from the threaded sleeve a distance which is at least about one half the predetermined axial height of the threaded sleeve.

19. The closure as defined in claim 16 wherein said overcap includes a central post which is positioned within the overcap and so as to be coaxially received in the spout and within the cavity of the self sealing dispensing valve, when the overcap is in the covering position.

* * * * *